US006368253B1

(12) United States Patent
Harrigan

(10) Patent No.: US 6,368,253 B1
(45) Date of Patent: Apr. 9, 2002

(54) IN-LINE ROLLER SKATE EXERCISE DEVICE

(76) Inventor: Mathew Harrigan, 101 W. 27th St., New York City, NY (US) 10001

( * ) Notice: Subject to any disclaimer, the term of this patent is extended or adjusted under 35 U.S.C. 154(b) by 0 days.

(21) Appl. No.: 09/026,061

(22) Filed: Feb. 19, 1998

(51) Int. Cl.[7] ..... A63B 21/00
(52) U.S. Cl. ..... 482/70; 482/51; 482/71
(58) Field of Search ..... 482/70, 54, 51, 482/52, 71; D21/193, 192, 191

(56) References Cited

U.S. PATENT DOCUMENTS

| | | | | | |
|---|---|---|---|---|---|
| 219,439 | A | * | 9/1879 | Blend | 482/70 |
| 3,941,377 | A | | 3/1976 | Beitostolen | |
| 4,402,506 | A | * | 9/1983 | Jones | 482/70 |
| 4,434,981 | A | | 3/1984 | Norton | |
| 4,529,194 | A | | 7/1985 | Haaheim | |
| 4,659,077 | A | | 4/1987 | Stropkay | |
| 4,948,121 | A | | 8/1990 | Haaheim | |
| 4,960,276 | A | | 10/1990 | Fener | |
| D358,436 | S | | 5/1995 | Piaget | D21/191 |
| 5,451,194 | A | | 9/1995 | Harrigan | 482/70 |
| 5,709,632 | A | * | 1/1998 | Socwell | 482/54 |
| 5,833,584 | A | * | 11/1998 | Piaget et al. | 482/70 |

* cited by examiner

*Primary Examiner*—Jerome Donnelly
(74) *Attorney, Agent, or Firm*—Robert W J Usher

(57) ABSTRACT

An in-line roller skate exercise device has a pair of, open ended, channel section tracks extending in side by side relation for receiving a pair of in-line roller skates worn by a person. The tracks are arcuate, forming progressively elevated front and rear track ends so that respective in-line roller skates of a pair worn by a person can be rolled by the person in opposed reciprocating motions along said tracks. Each track is of downwardly convergent channel section for engaging wheels of a respective roller skate with a wedging action providing frictional resistance to the motions of the roller skates thereby to increase substantially the effort of the person. The tracks can be formed by elongate stands molded as hollow shells with open bottoms for stacking, one inside another, facilitating compact storage and portability.

12 Claims, 2 Drawing Sheets

IN-LINE ROLLER SKATE EXERCISE DEVICE

FIELD OF THE INVENTION

The invention relates to an in-line roller skate exercise device for permitting opposed reciprocating motions of a user's legs.

BACKGROUND OF THE INVENTION

Numerous exercise apparatus which permit opposed reciprocating motions of a user's legs, often to simulate cross-country skiing, have been proposed. For example, U.S. Pat. No. 4,434,981 issued in 1984 to Norton; U.S. Pat. No. 4,529,194 issued 1985 to Haaheim; U.S. Pat. No. 4,659,077 issued 1987 to Stropkay; U.S. Pat. No. 4,984,121 issued 1990 to Haaheim; U.S. Pat. No. 4,960,276 issued 1990 to Feuer; and U.S. Pat. No. Des 358,436 issued 1995 to Piaget which teaches an arcuately tracked device.

However the apparatus taught by many of the above mentioned patents is relatively bulky, complex and expensive to manufacture and time consuming to assemble and disassemble.

U.S. Pat. No. 5,451,194 issued 1995, to the present applicant teaches an approach which is simpler in some respects in providing a platform on which in-line roller skates worn by a person can be rolled by the person in opposed reciprocating motions against the resistance of tie means attached adjacent the persons ankles and the platform thereby increasing the effort required.

However, the requirement to fasten and unfasten the tie means can be undesirably time consuming and fiddlesome.

SUMMARY OF THE INVENTION

It is an object of the invention to overcome the above mentioned disadvantage by providing an in-line roller skate exercise device for permitting opposed reciprocating motions of a user's legs in a manner somewhat similar to cross-country skiing while providing a resistance to such motion while avoiding any fastening and unfastening steps.

It is another object of the invention to provide a device which is of relatively simple and compact construction, is easily stored in a condition immediately ready for use, does not require any assembly steps and can be manufactured economically by conventional mass production techniques.

According to the invention there is provided, an in-line roller skate exercise device comprising means providing a pair of channel section tracks extending in side by side relation for receiving a pair of in-line roller skates worn by a person, the tracks being arcuate, forming progressively elevated front and rear track ends so that respective in-line roller skates of a pair worn by a person can be rolled by the person in opposed reciprocating motions along said tracks; each track being of downwardly convergent channel section for engaging wheels of a respective roller skate with a wedging action providing frictional resistance to the motions of the roller skates thereby to increase substantially the effort of the person.

Preferably, each channel section is a groove of substantially V section. This facilitates accommodation of any progressive wear in the skate wheels.

In one embodiment, the track providing means comprise a pair of elongate stands molded from plastic material as a hollow shell with an open bottom whereby the stands can be stacked in nested condition, one inside another, facilitating compact storage and portability.

In another embodiment, the track providing means comprise a unitary stand molded in one piece from plastic material.

It is also preferred that the tracks are open-ended to permit free leg movement.

BRIEF DESCRIPTION OF THE DRAWINGS

In order that the invention may be readily understood, specific embodiments thereof will now be described with reference to the accompanying drawings in which.

DESCRIPTION OF PARTICULAR EMBODIMENTS

Figure 1:
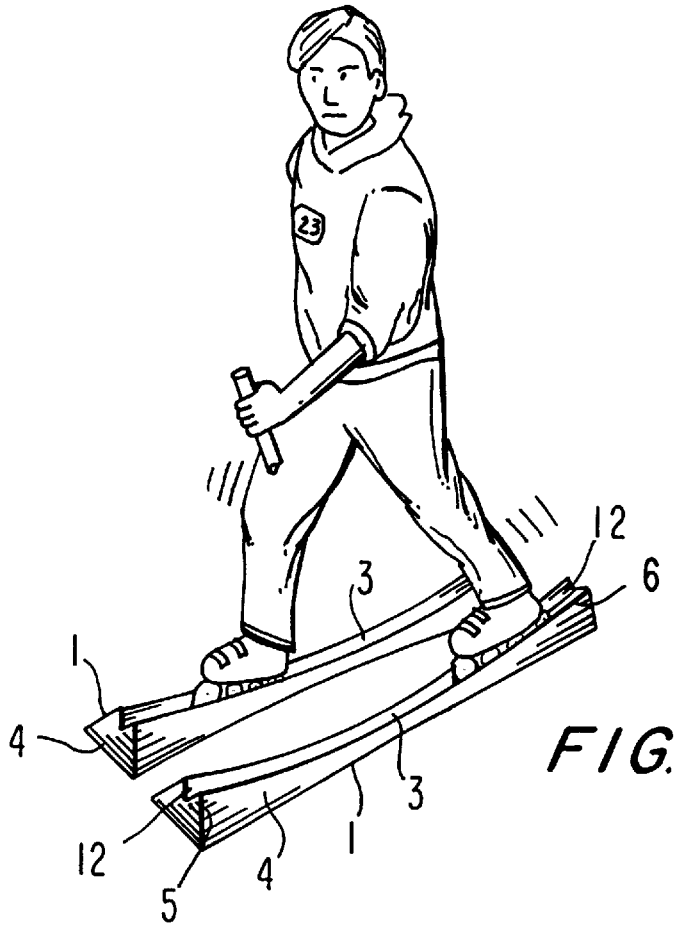
FIG. 1 is a diagrammatic perspective view of a first embodiment of the invention in use.
Figure 2:
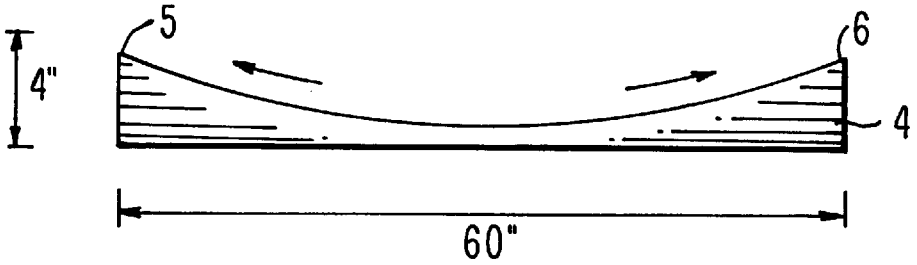
FIG. 2 is a diagrammatic side elevation of the first embodiment.
Figure 3:
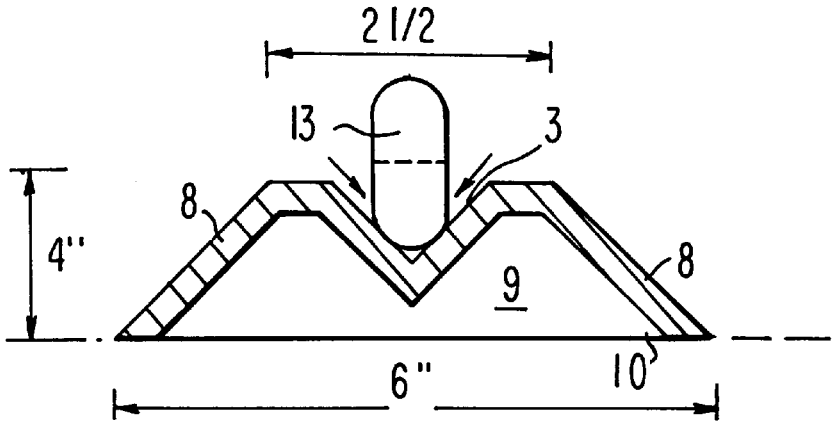
FIG. 3 is a diagrammatic cross-sectional view of an individual track stand of the first embodiment.

As shown in FIGS. 1–3, the first embodiment comprises a pair of channel section track members 1 extending in side by side relation for receiving a pair of in-line roller skates 2 worn by a person. The track members 1 are formed by V—section grooves 3 in upper surfaces of elongate stand members 4 and are arcuate, progressively elevating towards front and rear track ends 5 and 6, respectively.

Each stand 4 member is molded in one piece from plastic material as a hollow shell with opposite upwardly inclined longitudinal side walls 8 vertical end walls 9 and open bottom 10 whereby stands can be stacked in nested condition, one inside another, facilitating compact storage while the hollow construction also reduces weight improving portability.

The grooves 3 are open at opposite ends 11 and 12 to permit fluid, non-stop motion and full leg extension. while permitting fluid motion. As shown in FIG. 3, The inclined walls engage the opposite sides of the skate wheels 13 adjacent the rims with a wedging action and provide frictional resistance to motion. The wedging action of the V—section grooves can also enhance user stability.

The arcuate form also assists user in fluid, non-stop "cross-country skiing" type movement while also providing some desirable resistance to upswing of the legs.

In use, the track members are placed on a floor parallel to each other and spaced apart a distance equal to the hips of the user. The user, wearing in-line roller skates, inserts the skate wheels into respective grooves at the longitudinal centers thereof and begins by moving one leg and an opposite arm forward and the other leg and other arm rearward with a striding action simulating a cross-country skiing motion. When each leg reaches the top of its upswing it start to return to center and in a single, uninterrupted motion continues to the opposite end of the track, repetition enabling the user to exercise the body.

Figure 4:
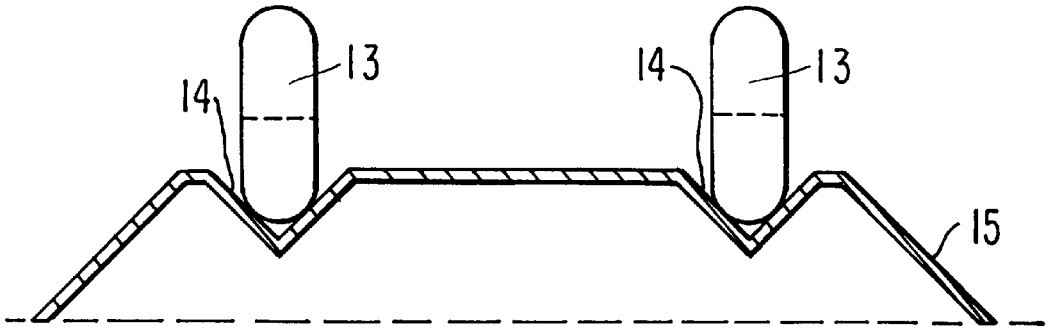
FIG. 4 is a diagrammatic cross-sectional view of a second embodiment of the invention wherein two tracks are provided by a unitary stand structure.

In a second embodiment, shown in FIG. 4, both tracks are provided by parallel grooves 14 formed the upper surface of a unitary platform or stand member 15.

Figure 5:
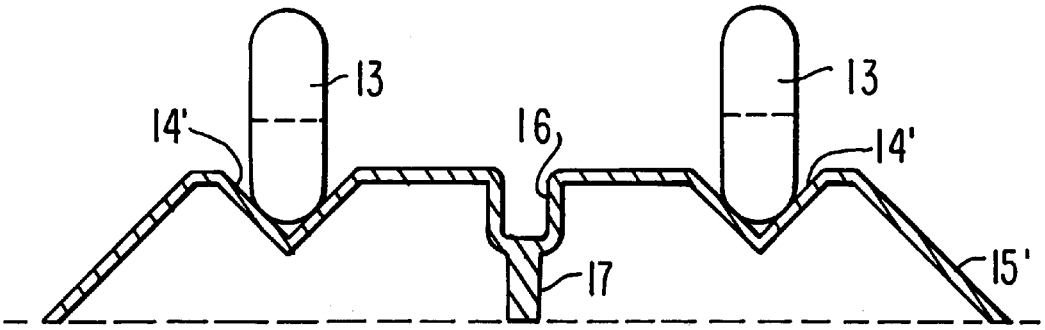
FIG. 5 is a diagrammatic cross-sectional view of a third embodiment, similar to the second embodiment, but employing a stronger stackable construction.

In a third embodiment, shown in FIG. 5, the upper surface of the stand member 15' is formed with a longitudinally extending recess 16 and a floor engaging strut for increased strength while permitting stacking in nest condition for compact storage.

The track members may be made from any suitable material, such as wood.

In any embodiment, if desired, elastic cords could be attached between the front and rear ends of the tracks and the users ankles to increase the resistance to motion.

I claim:

1. An in-line roller skate exercise device comprising:

a pair of in line roller skates;

means providing a pair of channel section tracks extending in side by side relation, the tracks being arcuate and thereby progressively elevated toward front and rear track ends, so that respective in-line roller skates of a pair worn by a person can be rolled by the person in opposed reciprocating motions along said tracks; each channel section track being of substantially v section, defined by substantially straight, downwardly convergent opposed sidewalls extending throughout substantially entire lengths of the tracks for engaging wheels of a respective roller skate with a wedging action to resist the motions of the roller skate thereby to increase substantially the effort of the person.

2. An in-line roller skate exercise device according to claim 1, wherein the track providing means comprise a pair of elongate stands molded from plastic material.

3. An in-line roller skate exercise device according to claim 2, wherein each stand comprises a hollow shell with an open bottom whereby the stands can be stacked in nested condition, one inside another.

4. An in-line roller skate exercise device according to claim 1, wherein the track providing means comprise a unitary stand molded in one piece from plastic material.

5. An in-line roller skate exercise device according to claim 1, wherein the tracks are open - ended at both respective front and rear ends thereof.

6. An in-line roller skate exercise device comprising:

a pair of in line roller skates;

means providing a pair of channel section tracks extending in side by side relation, the tracks being arcuate and thereby progressively elevated toward front and rear ends, so that respective in-line roller skates of the pair worn by a person can be rolled by the person in opposed reciprocating motions along said tracks; each track being of downwardly convergent channel section for engaging wheels of a respective roller skate with a wedging action to resist the motions of the roller skates thereby to increase substantially the effort of the person.

7. An in-line roller skate exercise device comprising:

means providing a pair of channel section tracks extending in side by side relation so that respective in-line roller skates of a pair worn by a person can be rolled by the person in opposed reciprocating motions along said tracks; each channel section track being of substantially V section, defined by substantially straight, downwardly convergent opposed sidewalls extending throughout substantially entire lengths of the tracks for engaging wheels of a respective roller skate with a wedging action to resist motions of the roller skates thereby to increase substantially the effort of the person.

8. An in-line roller skate exercise device according to claim 6, a pair of in line roller skates;

wherein each channel section is a groove of substantially V section defined by substantially straight, downwardly convergent opposed sidewalls.

9. An in-line roller skate exercise device according to claim 6, wherein the track providing means comprise a pair of elongate stands molded from plastic material.

10. An in-line roller skate exercise device according to claim 9, wherein each stand comprises a hollow shell with an open bottom whereby the stands can be stacked in nested condition, one inside another.

11. An in-line roller skate exercise device according to claim 6, wherein the track providing means comprise a unitary stand molded in one piece from plastic material.

12. An in-line roller skate exercise device according to claim 6, wherein the tracks are open-ended at both respective front and rear ends thereof.

* * * * *